US009324256B2

(12) United States Patent
Liao et al.

(10) Patent No.: US 9,324,256 B2
(45) Date of Patent: Apr. 26, 2016

(54) LIQUID CRYSTAL DISPLAY PANEL

(71) Applicant: AU Optronics Corp., Hsin-Chu (TW)

(72) Inventors: Wei-Chien Liao, Hsin-Chu (TW); Ming-Hung Chuang, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 384 days.

(21) Appl. No.: 13/754,905

(22) Filed: Jan. 31, 2013

(65) Prior Publication Data

US 2014/0098014 A1 Apr. 10, 2014

(30) Foreign Application Priority Data

Oct. 5, 2012 (TW) ..... 101136936 A

(51) Int. Cl.
*G09G 3/20* (2006.01)
*G09G 3/36* (2006.01)

(52) U.S. Cl.
CPC ..... *G09G 3/2085* (2013.01); *G09G 3/3674* (2013.01); *G09G 2300/0426* (2013.01); *G09G 2310/0281* (2013.01)

(58) Field of Classification Search
CPC ..... G09G 3/3648; G09G 2310/0286
See application file for complete search history.

(56) References Cited

U.S. PATENT DOCUMENTS

| | | | | |
|---|---|---|---|---|
| 7,605,793 | B2 | 10/2009 | Lee | |
| 2006/0038767 | A1 | 2/2006 | Nakamura | |
| 2008/0055282 | A1* | 3/2008 | Lee | 345/204 |
| 2008/0266275 | A1* | 10/2008 | Tsai et al. | 345/204 |
| 2010/0026619 | A1* | 2/2010 | Umezaki | 345/100 |
| 2010/0328280 | A1 | 12/2010 | Wu | |

FOREIGN PATENT DOCUMENTS

| | | | |
|---|---|---|---|
| CN | 101465165 | A | 6/2009 |
| CN | 101937636 | A | 1/2011 |

* cited by examiner

*Primary Examiner* — Kent Chang
*Assistant Examiner* — Chayce Bibbee
(74) *Attorney, Agent, or Firm* — Winston Hsu; Scott Margo

(57) ABSTRACT

A liquid crystal display panel includes a pixel array, a first shift register, M first output cells, a second shift register, and N second output cells. The first register is disposed on a first side of the pixel array. The M first output cells are coupled to and next to the first shift register for providing M gate signals to M rows of the pixel array according to a first clock signal. The second register is disposed on a second side of the pixel array. The N second output cells are coupled to and next to the second shift register for providing N gate signals to N rows of the pixel array according to a second clock signal. M and N are positive integers.

12 Claims, 14 Drawing Sheets

LIQUID CRYSTAL DISPLAY PANEL

BACKGROUND OF THE INVENTION

1. Field of the Invention

The disclosure is related to a liquid crystal display panel, and more particularly, to a liquid crystal display panel having two side co-used shift registers.

2. Description of the Prior Art

FIG. 1 is a diagram illustrating a prior art liquid crystal display panel 100. The liquid crystal display panel 100 includes a pixel array 102, shift registers 104, and an outer frame 106. As demand for high resolution liquid crystal display panels grows, number and rows of pixels in the pixel array 102 increase. Thus each pixel in high resolution liquid crystal display panels becomes smaller. Layout height H of each shift register 104 used to drive each row of pixels is limited, so layout width W of the shift register 104 must increase in order to accommodate components and traces in the shift register 104. However, as narrower length L of the outer frame 106 is required, there is a limitation to how much the layout width W may increase and the components and traces in the shift register 104 may not be laid out completely in a limited area.

SUMMARY OF THE INVENTION

An embodiment of the disclosure discloses a liquid crystal display panel. The liquid crystal display panel comprises a pixel array, a first shift register, M first output cells, a second shift register, and N second output cells. The first shift register is disposed on a first side of the pixel array for outputting a first clock signal. The M first output cells are coupled to and next to the first shift register for providing M gate signals to M rows of the pixel array according to the first clock signal. The second shift register is disposed on a second side of the pixel array for outputting a second clock signal. The N second output cells are coupled to and next to the second shift register for providing N gate signals to N rows of the pixel array according to the second clock signal. The first side is different from the second side, and M and N are positive integers.

These and other objectives of the disclosure will no doubt become obvious to those of ordinary skill in the art after reading the following detailed description of the preferred embodiment that is illustrated in the various figures and drawings.

DETAILED DESCRIPTION

Figure 1:
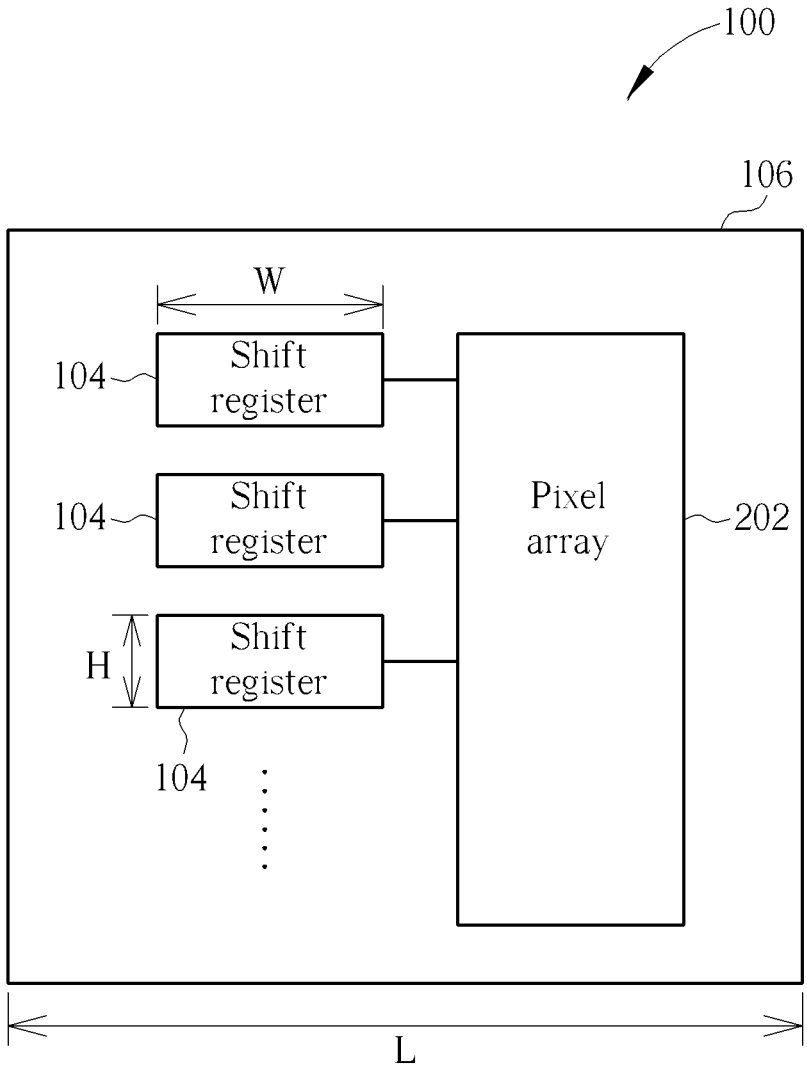
FIG. 1 PRIOR ART
FIG. 1 is a diagram illustrating a prior art liquid crystal display panel.
Figure 2:
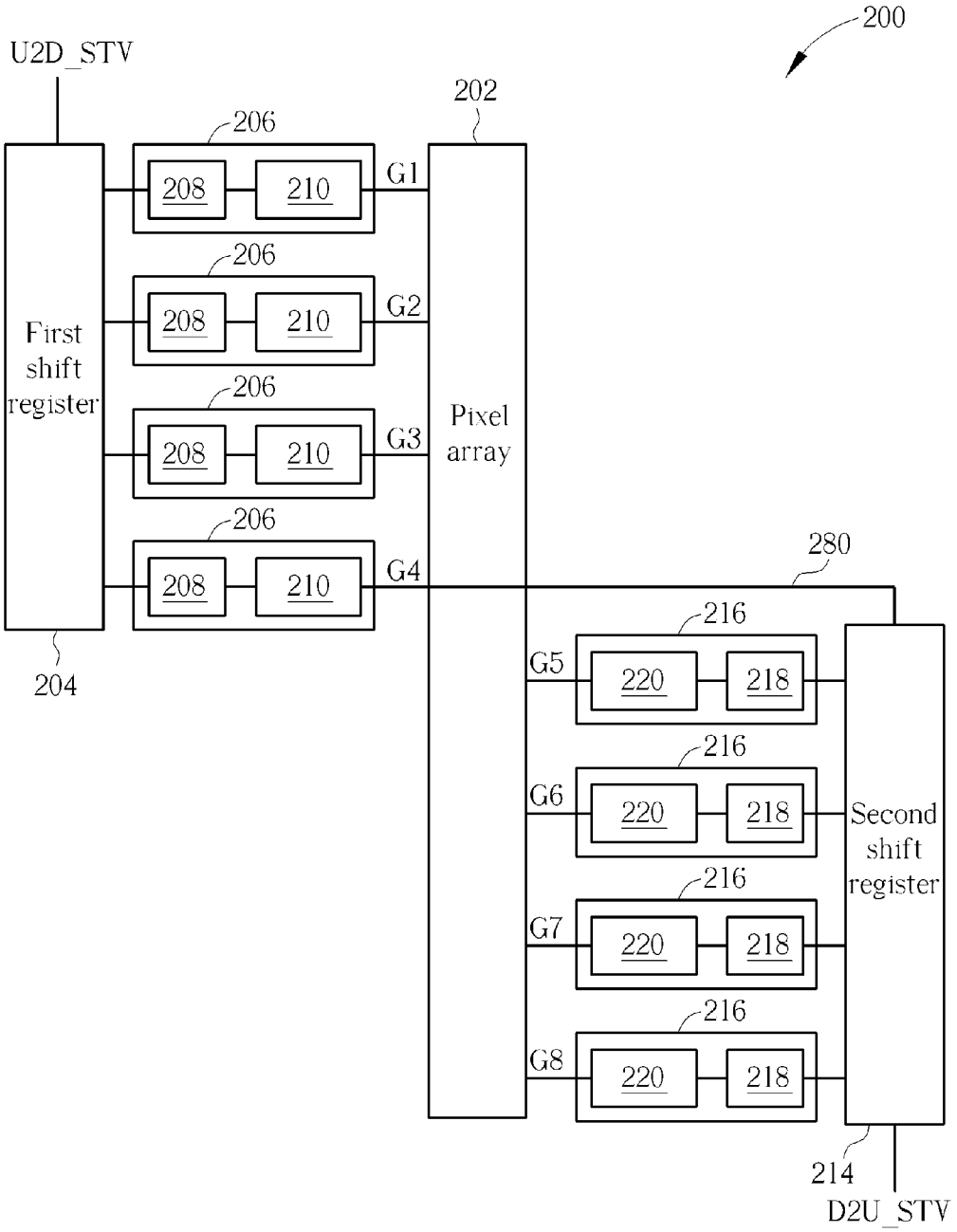
FIG. 2 is a diagram illustrating a liquid crystal display (LCD) panel according to an embodiment of the disclosure.

Please refer to FIG. 2, which is a diagram illustrating a liquid crystal display (LCD) panel 200 according to an embodiment of the disclosure. The LCD panel 200 includes a pixel array 202, a first shift register 204, first output cells 206, a second shift register 214, and second output cells 216. The first shift register 204 is disposed on a left side of the pixel array 202, and the second shift register 214 is disposed on a right side of the pixel array 202. FIG. 2 shows 4 rows of the first output cells 206 coupled between the first shift register 204 and the pixel array 202. The first output cells 206 are next to the first shift register 204. FIG. 2 also shows 4 rows of the second output cells 216 coupled between the second shift register 214 and the pixel array 202. The second output cells 216 are next to the second shift register 214. In other words, a plurality of output cells may share a same shift register. Four rows of the first output cells 206 are disposed above 4 rows of the second output cells 216. In practice, the number of the shift register and the output cells may increase according to number of rows of the pixel array 202 in a sequential arrangement analogous to FIG. 2. Embodiments of the disclosure are not limited to coupling 4 rows of the first output cells 206 to the first shift register 204. M first output cells 206 may be coupled to the first shift register 204, where M is a positive integer. N second output cells 216 may be coupled to the second shift register 214, where N is a positive integer. Each first output cell 206 includes a first logic gate 208 and a first buffer 210. Each second output cell 216 includes a second logic gate 218 and a second buffer 220.

Figure 3:
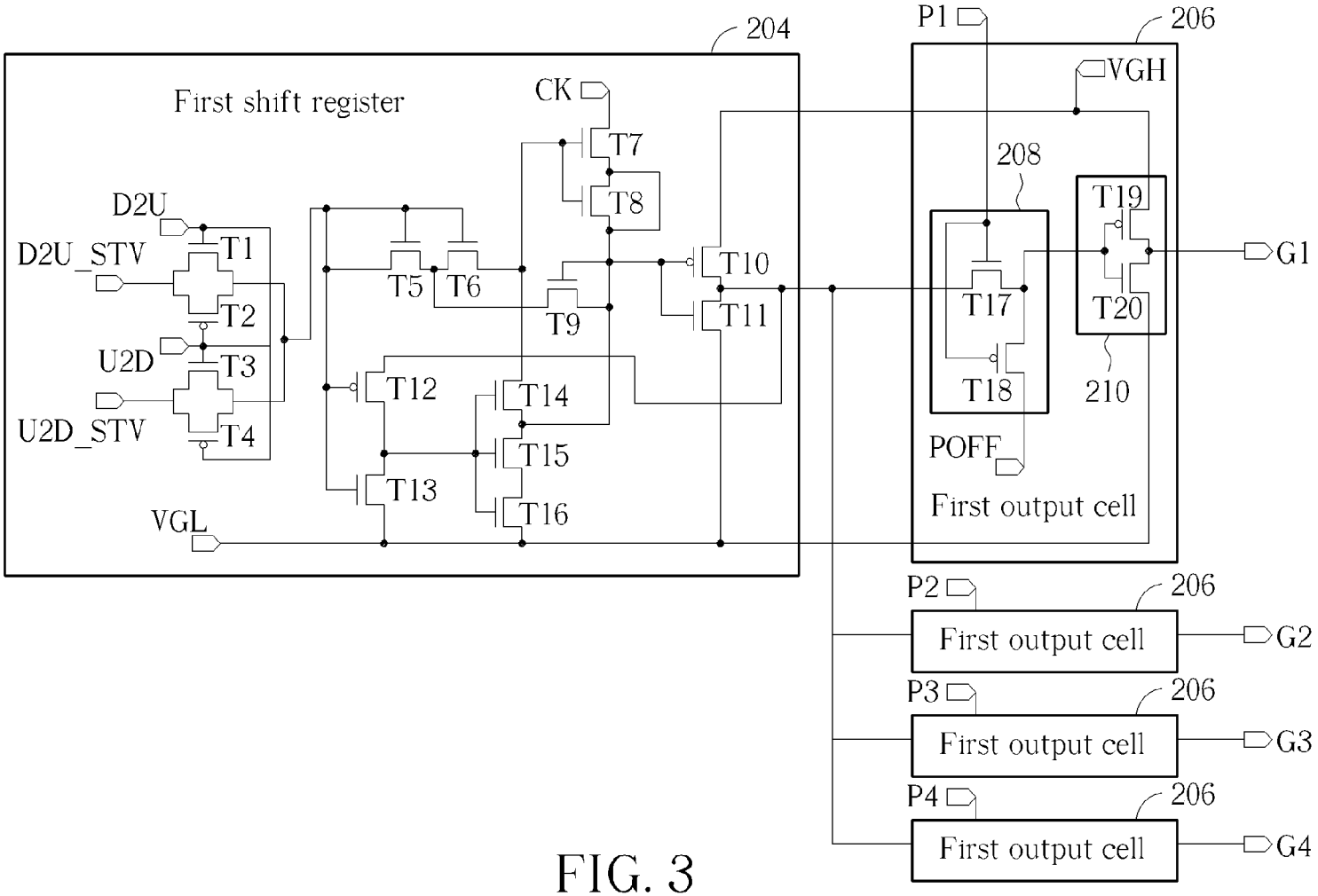
FIG. 3 is a diagram illustrating the first shift register and the first output cells according to an embodiment of the disclosure.

FIG. 3 is a diagram illustrating the first shift register 204 and the first output cells 206 according to an embodiment of the disclosure. Four first output cells 206 in FIG. 3 are identical. The first shift register 204 includes a first transistor T1 to a sixteenth transistor T16. Each first logic gate 208 includes a seventeenth transistor T17 and an eighteenth transistor T18. Each first buffer 210 includes a nineteenth transistor T19 and a twentieth transistor T20.

The first transistor T1 has a control terminal for receiving an upward transmission signal D2U and a first terminal for receiving an upward transmission start signal D2U_STV. A second transistor T2 has a control terminal for receiving a downward transmission signal U2D, a first terminal coupled to the first terminal of the first transistor T1, and a second terminal coupled to a second terminal of the first transistor T1. A third transistor T3 has a control terminal coupled to the control terminal of the second transistor T2, a first terminal for receiving a downward transmission start signal U2D_STV, and a second terminal coupled to the second terminal of the second transistor T2. A fourth transistor T4 has a control terminal coupled to the control terminal of the first transistor T1, a first terminal coupled to the first terminal of the third transistor T3, and a second terminal coupled to the second terminal of the third transistor T3. A fifth transistor T5 has a control terminal coupled to the second terminal of the first transistor T1 and a first terminal coupled to the control terminal of the fifth transistor T5. A sixth transistor T6 has a control terminal coupled to the control terminal of the fifth transistor T5 and a first terminal coupled to a second terminal of the fifth transistor T5. A seventh transistor T7 has a control terminal coupled to a second terminal of the sixth transistor T6 and a first terminal for receiving a first clock signal CK. An eighth transistor T8 has a control terminal coupled to the control terminal of the seventh transistor T7, a first terminal coupled to a second terminal of the seventh transistor T7, and a second terminal coupled to the first terminal of the eighth transistor T8. A ninth transistor T9 has a control terminal coupled to the second terminal of the eighth transistor T8, a first terminal coupled to the first terminal of the sixth transistor T6, and a second terminal coupled to the control terminal of the ninth transistor T9. A tenth transistor T10 has a control terminal coupled to the control terminal of the ninth transistor T9, a first terminal for receiving a high voltage VGH, and a second terminal for outputting the first clock signal CK. An eleventh transistor T11 has a control terminal coupled to the control terminal of the tenth transistor T10, a first terminal coupled to the second terminal of the tenth transistor T10, and a second terminal for receiving a low voltage VGL. A twelfth transistor T12 has a control terminal coupled to the second terminal of the first transistor T1 and a first terminal coupled to the second terminal of the tenth transistor T10. A thirteenth transistor T13 has a control terminal coupled to the control terminal of the twelfth transistor T12, a first terminal coupled to a second terminal of the twelfth transistor T12, and a second terminal coupled to the second terminal of the eleventh transistor T11. A fourteenth transistor T14 has a control terminal coupled to the second of the twelfth transistor T12, a first terminal coupled to the second terminal of the sixth transistor T6, and a second terminal coupled to the control of the tenth transistor T10. A fifteenth transistor T15 has a control terminal coupled to the control terminal of the fourteenth transistor T14 and a first terminal coupled to the second terminal of the fourteenth transistor T14. The sixteenth transistor T16 has a control terminal coupled to the control terminal of the fourteenth transistor T14, a first terminal coupled to a second terminal of the fifteenth transistor T15, and a second terminal coupled to the second terminal of the eleventh transistor T11.

Take a first row of the first logic gates 208 and the first buffers 210 for example. The seventeenth transistor T17 has a control terminal for receiving a pulse signal P1 and a first terminal coupled to the second terminal of the tenth transistor T10. The eighteenth transistor T18 has a control terminal coupled to the control terminal of the seventeenth transistor T17, a first terminal coupled to a second terminal of the seventeenth transistor T17, and a second terminal for receiving a pulse off signal POFF. The nineteenth transistor T19 has a control terminal coupled to the second terminal of the seventeenth transistor T17, a first terminal for receiving the high voltage VGH, and a second terminal for outputting a gate signal G1 to a first row of the pixel array 202. The twentieth transistor T20 has a control terminal coupled to the control terminal of the nineteenth transistor T19, a first terminal coupled to the second terminal of the nineteenth transistor T19, and a second terminal coupled to the second terminal of the eleventh transistor T11. A counterpart of the seventeenth transistor T17 in a second row of the first logic gates 208 has a control terminal for receiving a pulse signal P2. A counterpart of the nineteenth transistor T19 in a second row of the first buffers 210 has a second terminal for outputting a gate signal G2 to a second row of the pixel array 202. Other rows of the first logic gates 208 and the first buffers 210 operate in an analogous manner.

The second shift register 214, the second logic gates 218, and the second buffers 220 are identical to the first shift register 204, the first logic gates 208, and the first buffers 210 respectively. In addition, the first terminal of the seventh transistor T7 of the second shift register 214 is for receiving a second clock signal CK', and the second terminal of the tenth transistor T10 is for outputting the second clock signal CK'.

Figure 4:
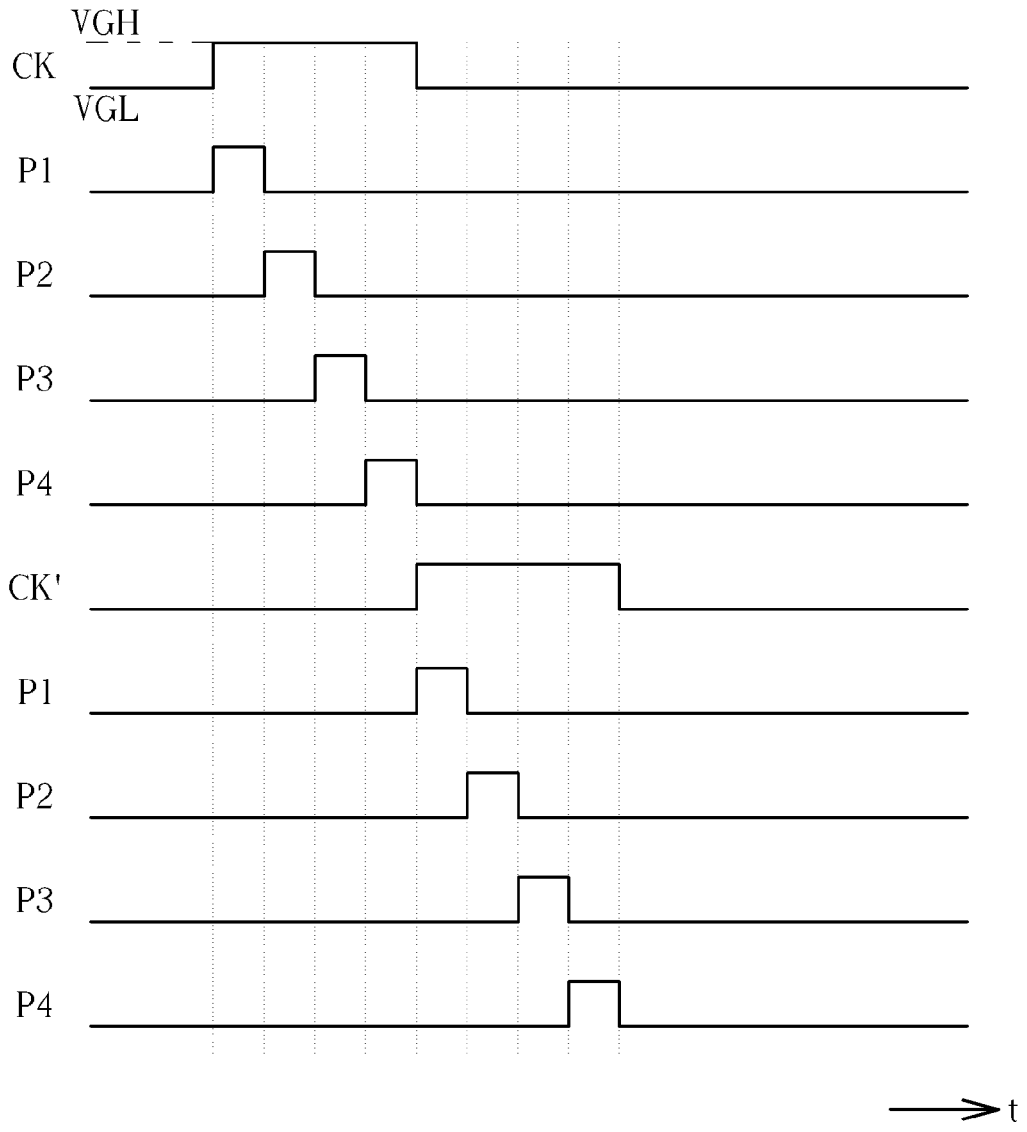
FIG. 4 is a timing diagram illustrating operations of the LCD panel of FIG. 2 according to an embodiment of the disclosure.

Please refer to FIG. 2 and FIG. 4 together. FIG. 4 is a timing diagram illustrating operations of the LCD panel 200 of FIG. 2 according to an embodiment of the disclosure. The abscissa axis of FIG. 4 is time t, and from top to bottom of FIG. 4 are the first clock signal CK, the pulse signal P1, the pulse signal P2, a pulse signal P3, a pulse signal P4, the second clock signal CK', the pulse signal P1, the pulse signal P2, the pulse signal P3, and the pulse signal P4. The LCD panel 200 begins to scan the pixel array 202 when the first shift register 204 receives the downward transmission start signal U2D_STV. When the first clock CK rises from the low voltage VGL to the high voltage VGH, the first shift register 204 outputs the high voltage VGH of the first clock signal CK to 4 rows of the first logic gates 208. When the pulse signal P1 and the first clock signal CK are both at the high voltage VGH, the first row of the first logic gates 208 outputs a pre-buffered gate signal to the first row of the first buffers 210, then the first row of the first buffers 210 receives the pre-buffered gate signal and outputs the gate signal G1 to the first row of the pixel array 202. Other rows of the first buffers 210 output the gate signal G2 to the second row, a gate signal G3 to a third row, a gate signal G4 to a fourth row of the pixel array 202 from top to bottom in an analogous manner. Alternatively, the LCD panel 200 may begin to scan the pixel array 202 from bottom to top on receiving the upward transmission start signal D2U_STV.

After a fourth row of the first buffers 210 has outputted the gate signal G4 to the fourth row of the pixel array 202, the downward transmission start signal U2D_STV is transmitted to the second shift register 214 via a start signal line 280, which is coupled and disposed between the first shift register 204 and the second shift register 214 by traversing through the pixel array 202. When the second clock signal CK' rises from the low voltage VGL to the high voltage VGH, the second shift register 214 outputs the high voltage VGH of the second clock signal CK' to 4 rows of the second logic gates 218. When the pulse signal P1 and the second clock signal CK' are both at the high voltage VGH, the first row of the second logic gates 218 outputs a pre-buffered gate signal to the first row of the second buffers 220, then the first row of the second buffers 220 receives the pre-buffered gate signal and outputs the gate signal G5 to the fifth row of the pixel 202. Other rows of the second buffers 220 output gate signals G6, G7, and G8 to the pixel array 202 in an analogous manner. In another embodiment, alternatively, the upward transmission start signal D2U_STV cooperating with the first clock signal CK, the pulse signal P1, the pulse signal P2, the pulse signal P3, the pulse signal P4, and the second clock signal CK' may be used to transmit the gate signals from bottom to top of the pixel array 202.

Figure 5:
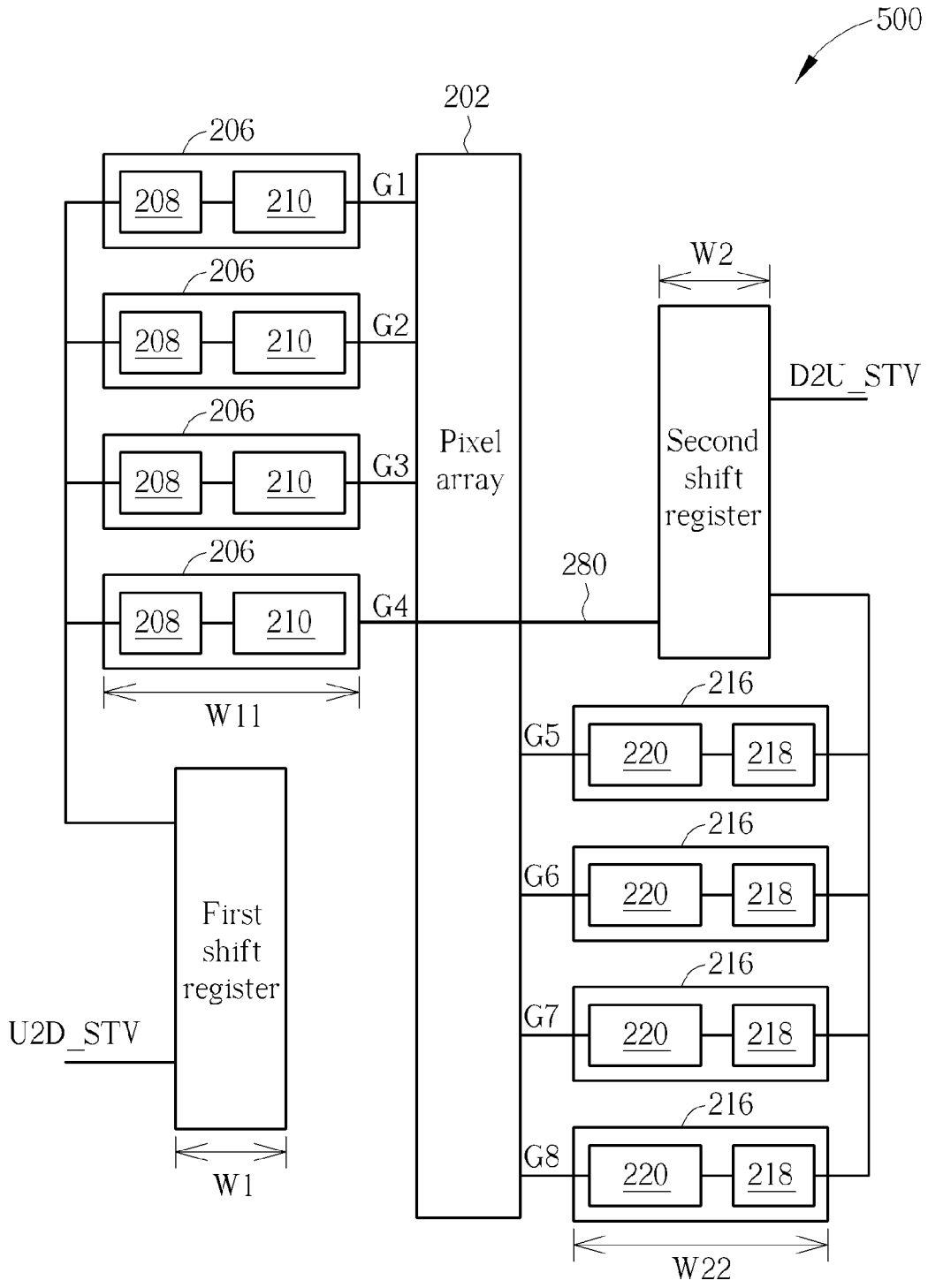
FIG. 5 is a diagram illustrating a liquid crystal display panel according to another embodiment of the disclosure.

FIG. 5 is a diagram illustrating a liquid crystal display panel 500 according to another embodiment of the disclosure. The LCD panel 500 includes the same components as the LCD panel 200 of FIG. 2 and operates in a manner analogous to the LCD panel 200, and only the layout is different. The first shift register 204 of the LCD panel 500 is disposed below 4 rows of the first output cells 206, and the second shift register 214 of the LCD panel 500 is disposed above 4 rows of the second output cells 216. In this embodiment, width W1 of the first shift register 204 is not greater than width W11 of each first output cell 206 and width W2 of the second shift register 214 is not greater than width W22 of each second output cell 216.

Figure 6:
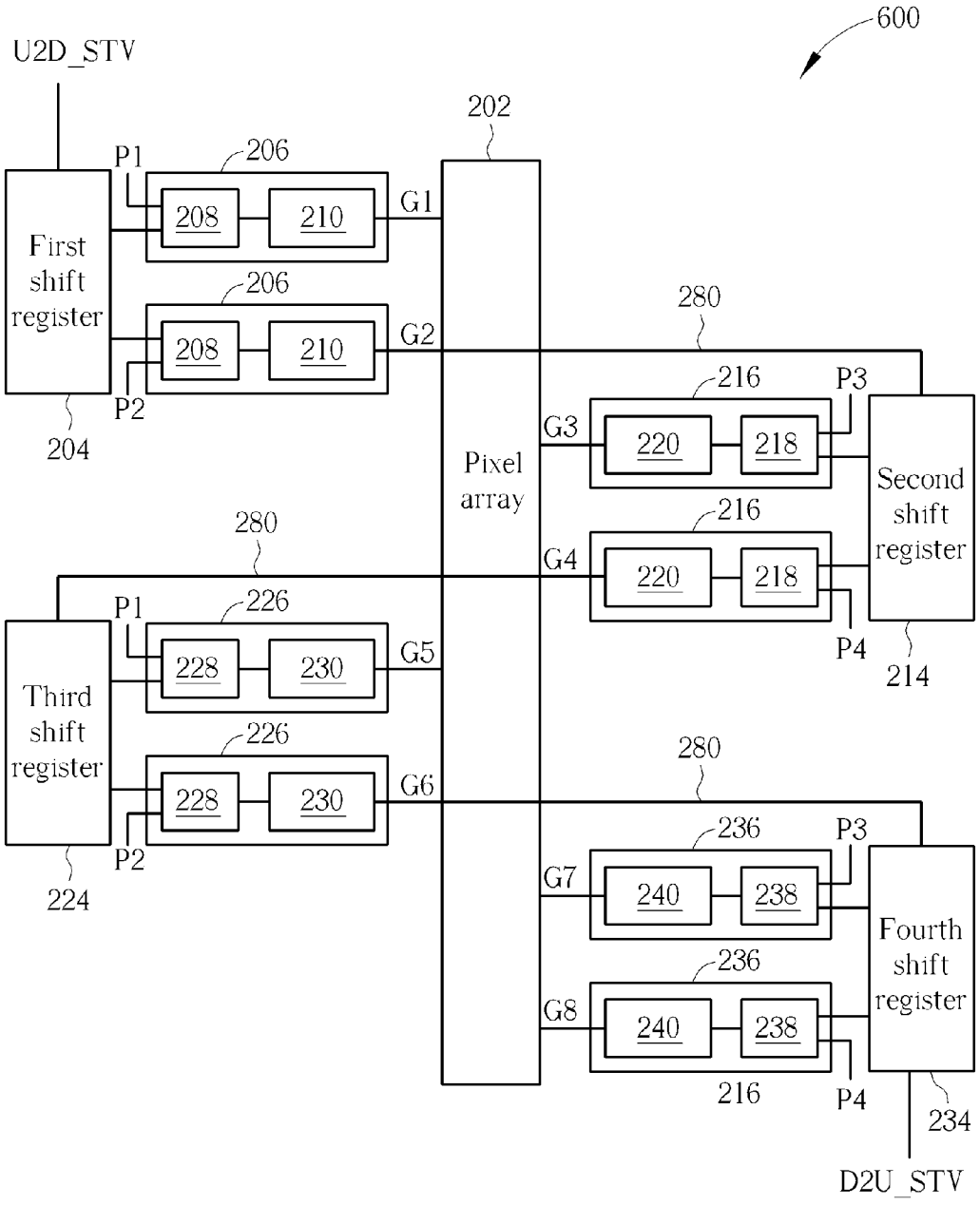
FIG. 6 is a diagram illustrating a liquid crystal display panel according to another embodiment of the disclosure.

FIG. 6 is a diagram illustrating a liquid crystal display panel 600 according to another embodiment of the disclosure. The LCD panel 600 includes the pixel array 202, the first shift register 204, the first output cells 206, the second shift register 214, the second output cells 216, a third shift register 224, a third output cells 226, a fourth shift register 234, and a fourth output cells 236. The first shift register 204 and the third shift register 224 are disposed on the left side of the pixel array 202, and the second shift register 214 and the fourth shift register 234 are disposed on the right side of the pixel array 202. FIG. 6 shows 2 rows of the first output cells 206 coupled to the first shift register 204, 2 rows of the second output cells 216 coupled to the second shift register 214, 2 rows of the third output cells 226 coupled to the third shift register 224, and 2 rows of the fourth output cells 236 coupled to the fourth shift register 234.

The first shift register 204, the second shift register 214, the third shift register 224, and the fourth shift register 234 of the LCD panel 600 are identical to the first shift register 204 of FIG. 2. Each first output cell 206, second output cell 216, third output cell 226, and fourth output cell 236 are identical to the first output cell 206 of FIG. 2. Each third output cell 226 includes a third logic gate 228 and a third buffer 230, and each fourth output cell 236 includes a fourth logic gate 238 and a fourth buffer 240.

Figure 7:
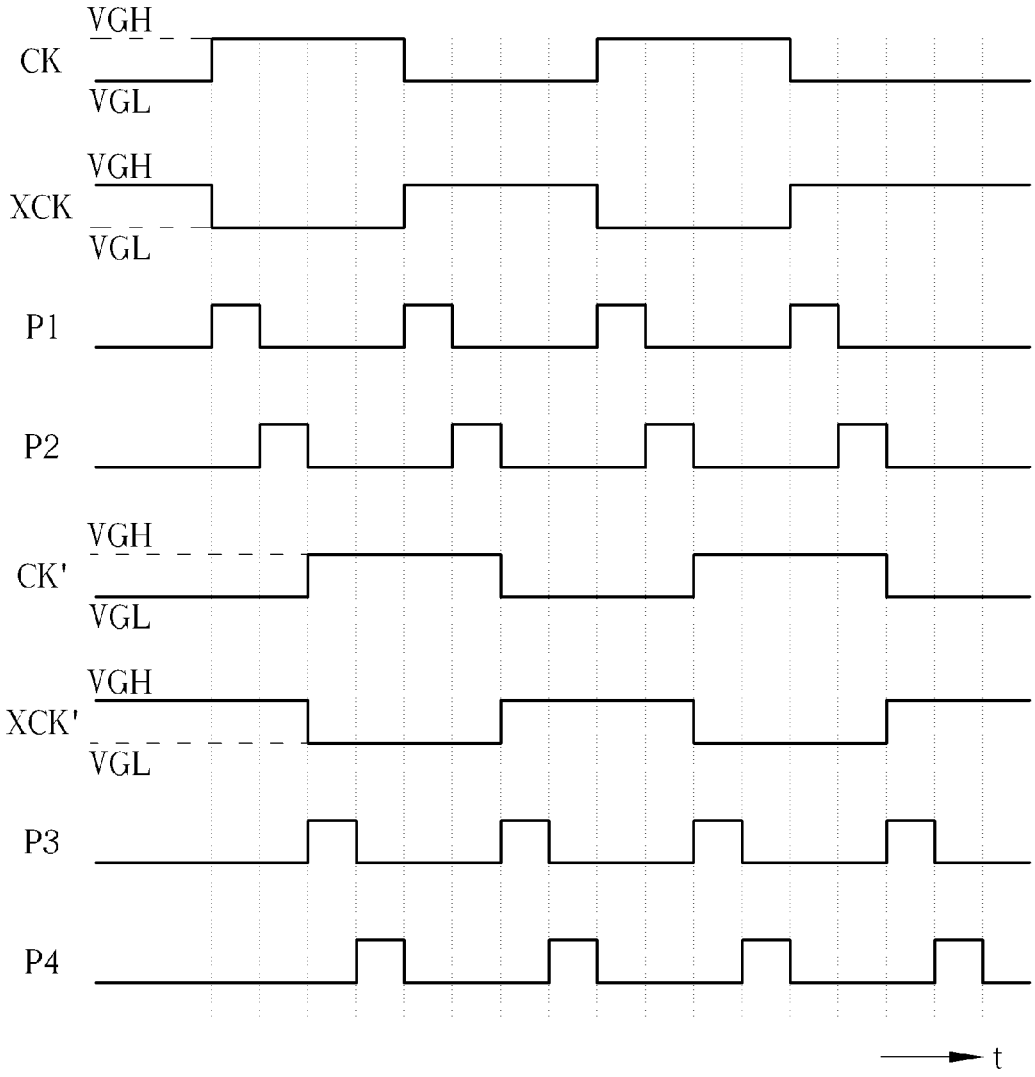
FIG. 7 is a timing diagram illustrating operations of the LCD panel according to an embodiment of the disclosure.

FIG. 7 is a timing diagram illustrating operations of the LCD panel 600 according to an embodiment of the disclosure. The abscissa axis of FIG. 7 is time t, and from top to bottom of FIG. 7 are the first clock signal CK, a third clock signal XCK, the pulse signal P1, the pulse signal P2, the second clock signal CK', a fourth clock signal XCK', the pulse signal P3, and the pulse signal P4. The LCD panel 600 begins to scan the pixel array 202 when the first shift register 204 receives the downward transmission start signal U2D_STV. When the first clock CK rises from the low voltage VGL to the high voltage VGH, the first shift register 204 outputs the high voltage VGH of the first clock signal CK to 2 rows of the first output cells 206. When the pulse signal P1 and the first clock signal CK are both at the high voltage VGH, the first row of the first output cells 206 outputs the gate signal G1 to the first row of the pixel 202. When the pulse signal P2 and the first clock signal CK are both at the high voltage VGH, the second row of the first output cells 206 outputs the gate signal G2 to the second row of the pixel 202. After the second row of the first output cells 206 has outputted the gate signal G2 to the second row of the pixel 202, the downward transmission start signal U2D_STV is transmitted to the second shift register 214 via the start signal line 280. When the second clock CK' rises from the low voltage VGL to the high voltage VGH, the second shift register 214 outputs the high voltage VGH of the second clock signal CK' to 2 rows of the second output cells 216. When the pulse signal P3 and the second clock signal CK' are both at the high voltage VGH, the first row of the second output cells 216 outputs the gate signal G3 to the third row of the pixel 202. When the pulse signal P4 and the second clock signal CK' are both at the high voltage VGH, the second row of the second output cells 216 outputs the gate signal G4 to the fourth row of the pixel 202. The gate signals G5 to G8 are outputted by the third output cells 226 and the fourth output cells 236 according to the third clock signal XCK, the fourth clock signal XCK', and the pulse signals P1 to P4 in an analogous manner as set forth above. Alternatively, the LCD panel 600 may begin to scan the pixel array 202 from bottom to top on receiving the upward transmission start signal D2U_STV.

Figure 8:
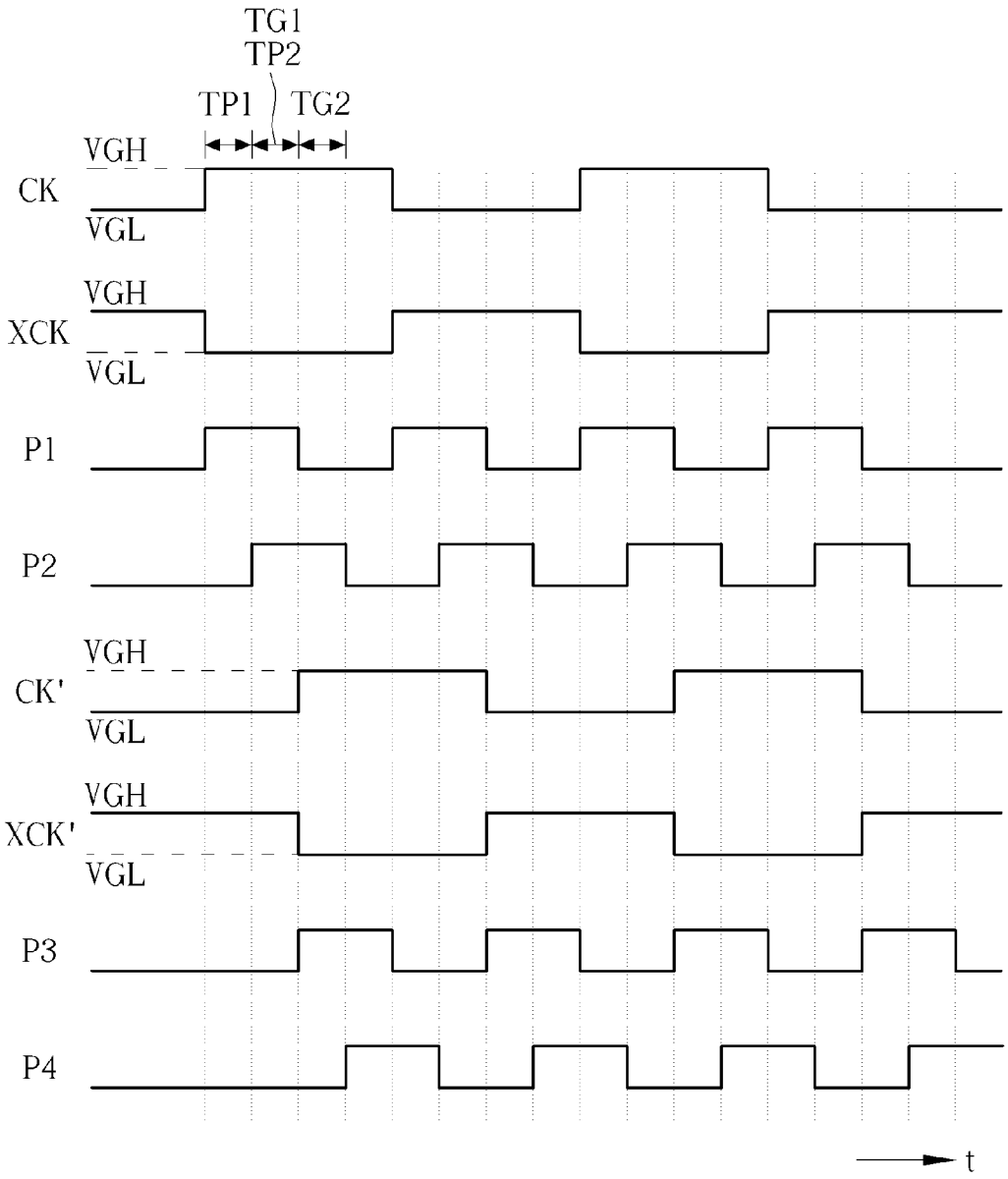
FIG. 8 is a timing diagram illustrating operations of the LCD panel according to another embodiment of the disclosure.

FIG. 8 is a timing diagram illustrating operations of the LCD panel 600 according to another embodiment of the disclosure. Each pulse signal in FIG. 8 contains an extra pre-charge period comparing with each pulse signal in FIG. 7. For example, when the pulse signal P1 and the first clock signal CK are both at the high voltage VGH, the first row of the first output cells 206 does not output the gate signal G1 during TP1 because TP1 is the pre-charge period. The gate signal G1 is then outputted during TG1. Similarly, when the pulse signal P2 and the first clock signal CK are both at the high voltage VGH, the second row of the first output cells 206 does not output the gate signal G2 during TP2 because TP2 is also the pre-charge period. The gate signal G2 is then outputted during TG2. Other gate signals in FIG. 8 are outputted in an analogous manner.

Figure 9:
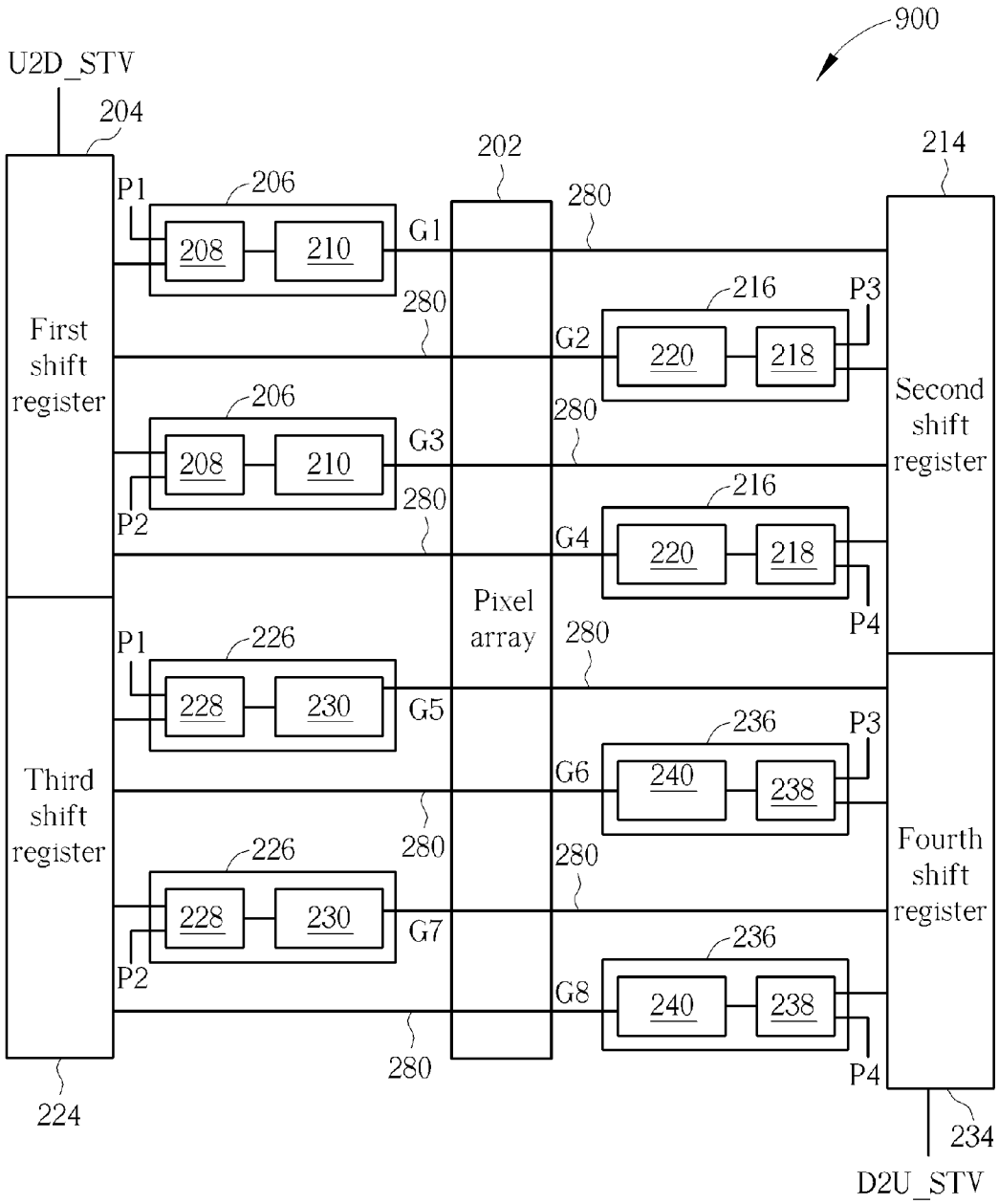
FIG. 9 is a diagram illustrating a liquid crystal display panel according to another embodiment of the disclosure.
Figure 10:
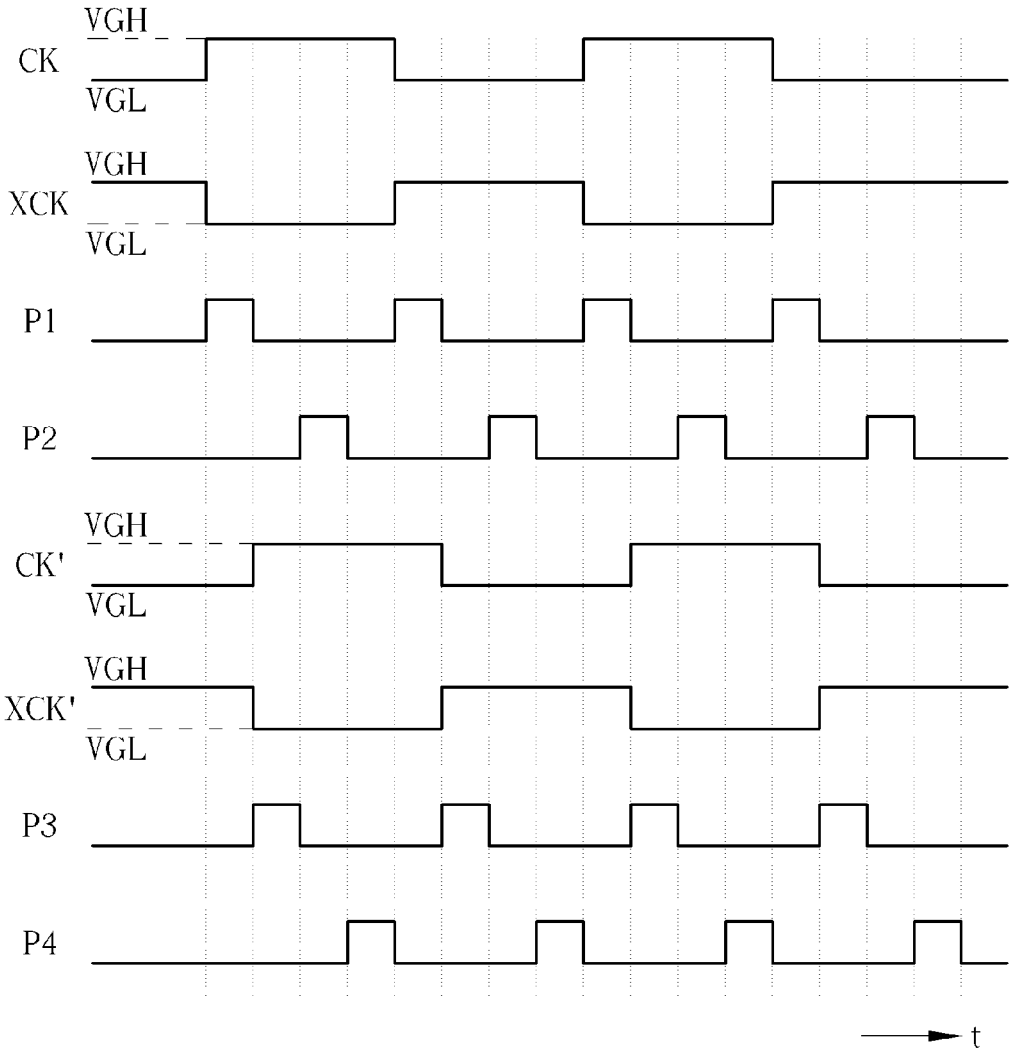
FIG. 10 is a timing diagram illustrating operations of the LCD panel according to an embodiment of the disclosure.
Figure 11:
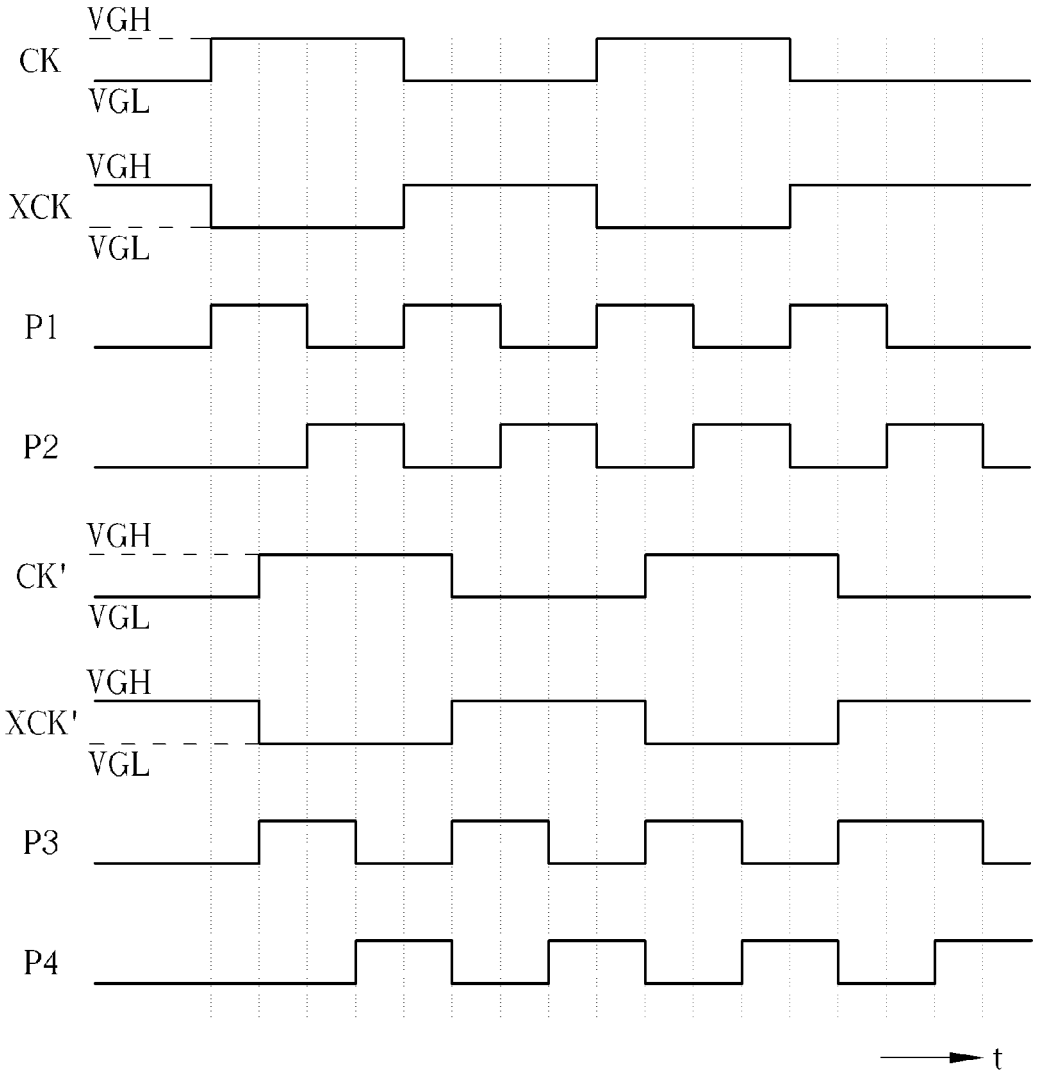
FIG. 11 is a timing diagram illustrating operations of the LCD panel according to another embodiment of the disclosure.

FIG. 9 is a diagram illustrating a liquid crystal display panel 900 according to another embodiment of the disclosure. FIG. 10 is a timing diagram illustrating operations of the LCD panel 900 according to an embodiment of the disclosure. FIG. 11 is a timing diagram illustrating operations of the LCD panel 900 according to another embodiment of the disclosure. A difference between the LCD panel 900 and the LCD panel 600 is that the first output cells 206, the second output cells 216, the third output cells 226, and the fourth output cells 236 of the LCD panel 900 are laid out in a zigzag manner. The LCD panel 900 begins to scan the pixel array 202 when the first shift register 204 receives the downward transmission start signal U2D_STV. After the first row of the first buffers 210 has outputted the gate signal G1, the downward transmission start signal U2D_STV is transmitted to the second shift register 214 via the start signal line 280. After the first row of the second buffers 220 has outputted the gate signal G2, the downward transmission start signal U2D_STV is transmitted to the first shift register 204 via the start signal line 280. The same principle applies to operations of other rows. A difference between FIG. 10 and FIG. 7 is that the pulse signals are generated interleavingly in FIG. 10, that is, an output sequence of the pulse signal in FIG. 10 is P1, P3, P2, and P4. The difference between FIG. 11 and FIG. 8 is that the pulse signals are generated interleavingly in FIG. 11, that is, an output sequence of the pulse signal in FIG. 11 is P1, P3, P2, and P4. Alternatively, the LCD panel 900 may begin to scan the pixel array 202 from bottom to top on receiving the upward transmission start signal D2U_STV.

Figure 12:
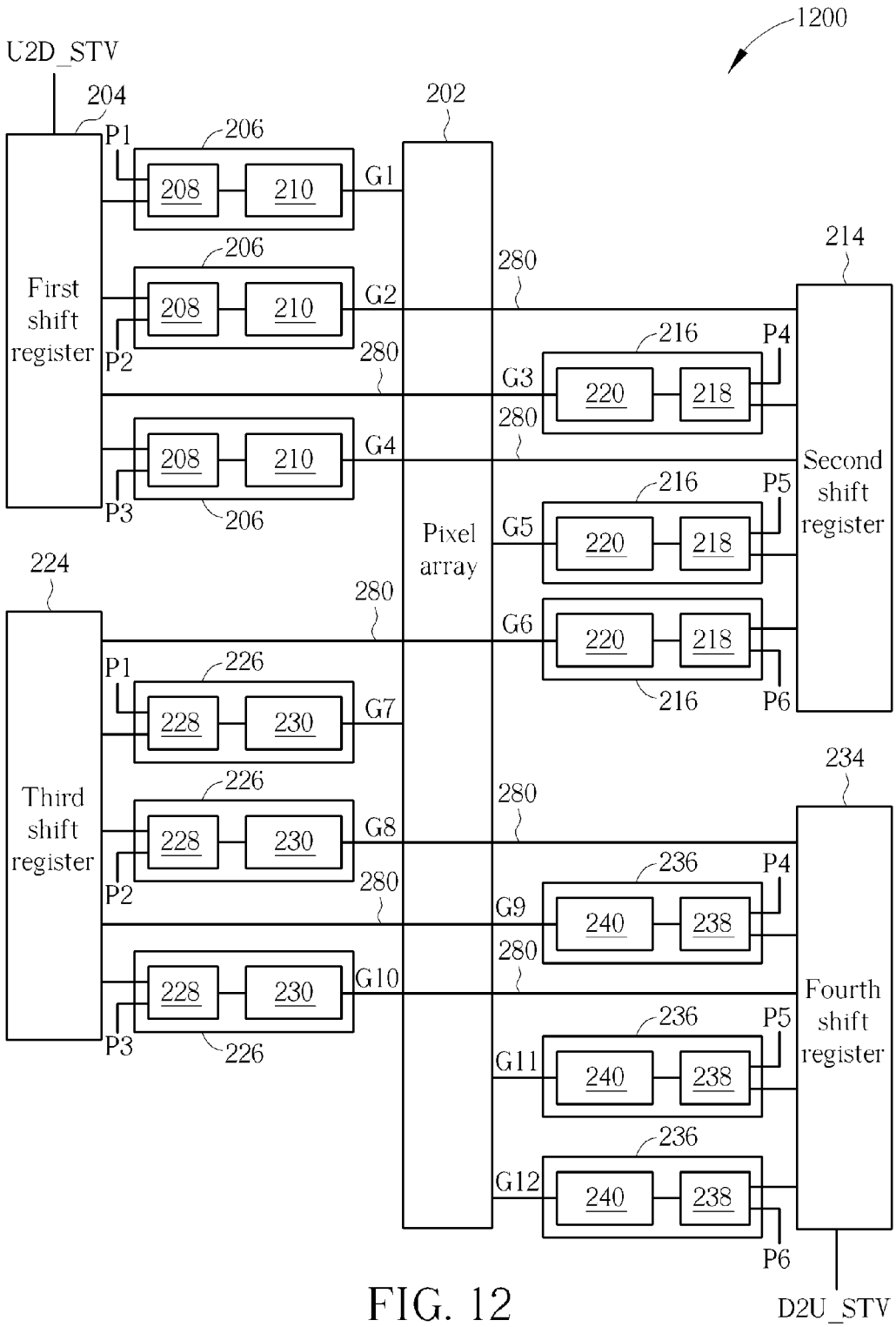
FIG. 12 is a diagram illustrating a liquid crystal display panel according to another embodiment of the disclosure.

FIG. 12 is a diagram illustrating a liquid crystal display panel 1200 according to another embodiment of the disclosure. The LCD panel 1200 includes the pixel array 202, the first shift register 204, the first output cells 206, the second shift register 214, the second output cells 216, the third shift register 224, the third output cells 226, the fourth shift register 234, and the fourth output cells 236. The first shift register 204 and the third shift register 224 are disposed on the left side of the pixel 202, the second shift register 214 and the fourth shift register 234 are disposed on the right side of the pixel 202. FIG. 12 shows 3 rows of the first output cells 206 coupled to the first shift register 204, 3 rows of the second output cells 216 coupled to the second shift register 214, 3 rows of the third output cells 226 coupled to the third shift register 224, 3 rows of the fourth output cells 236 coupled to the fourth shift register 234. The first row of the second output cells 216 is arranged below the first row and the second row of the first output cells 206 and above a third row of the first output cells 206. The third row of the first output cells 206 is arranged above the second row and a third row of the second output cells 216. A first row of the fourth output cells 236 is arrange below a first row and a second row of the third output cells 226 and above a third row of the third output cells 226. The third row of the third output cells 226 is arranged above a third row and a fourth row of the fourth output cells 236.

The first shift register 204, the second shift register 214, the third shift register 224, the fourth shift register 234, each first output cell 206, each second output cell 216, each third output cell 226, and each fourth output cell 236 of the LCD panel 1200 are identical to corresponding counterparts in FIG. 6.

Figure 13:
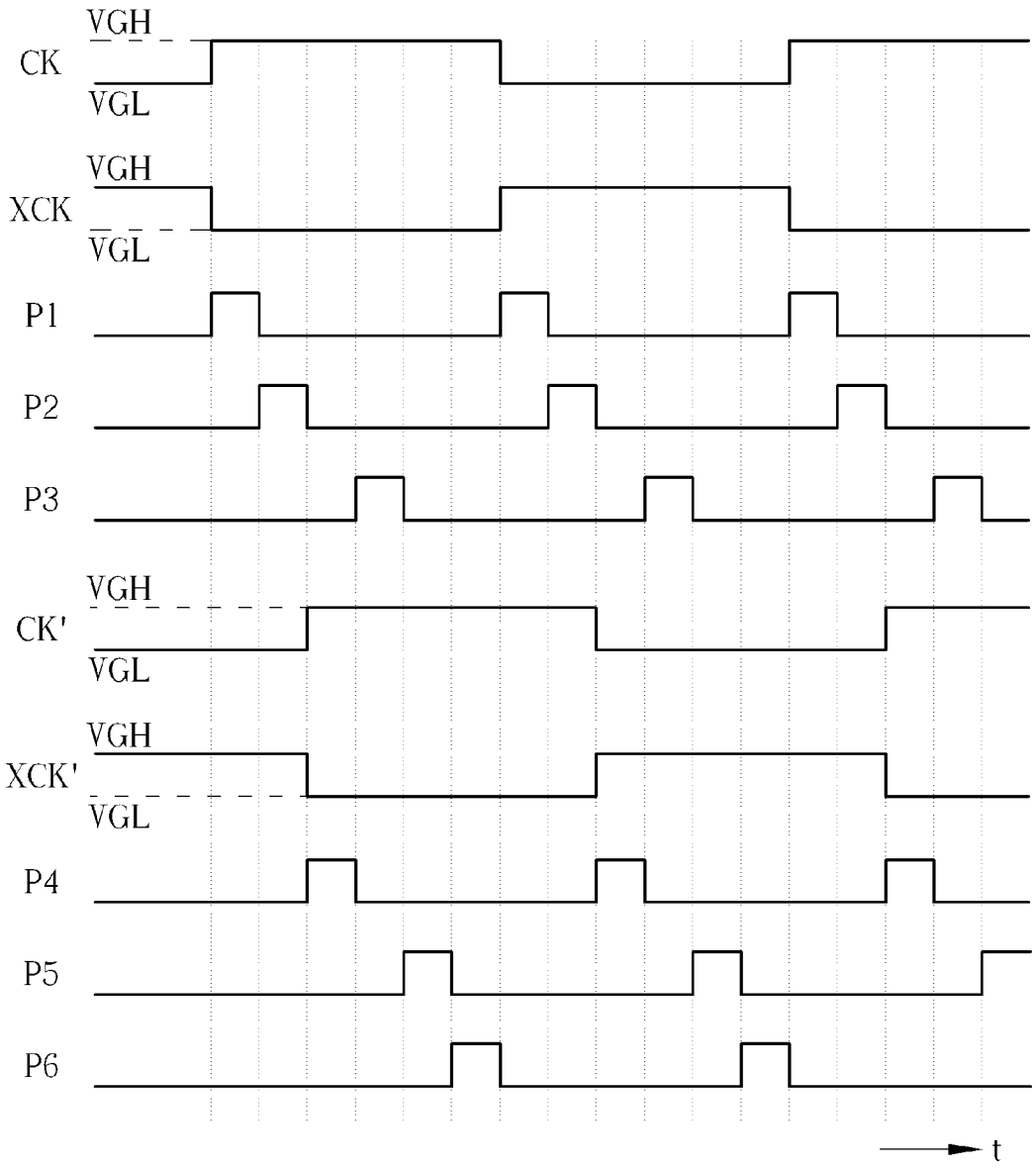
FIG. 13 is a timing diagram illustrating operations of the LCD panel according to an embodiment of the disclosure.

FIG. 13 is a timing diagram illustrating operations of the LCD panel 1200 according to an embodiment of the disclosure. The abscissa axis of FIG. 13 is time t, and from top to bottom of FIG. 13 are the first clock signal CK, the third clock signal XCK, the pulse signal P1, the pulse signal P2, the pulse signal P3, the second clock signal CK', the fourth clock signal XCK', the pulse signal P4, a pulse signal P5, and a pulse signal P6. The LCD panel 1200 begins to scan the pixel array 202 when the first shift register 204 receives the downward transmission start signal U2D_STV. When the first clock CK rises from the low voltage VGL to the high voltage VGH, the first shift register 204 outputs the high voltage VGH of the first clock signal CK to 3 rows of the first output cells 206. When the pulse signal P1 and the first clock signal CK are both at the high voltage VGH, the first row of the first output cells 206 outputs the gate signal G1 to the first row of the pixel 202. When the pulse signal P2 and the first clock signal CK are both at the high voltage VGH, the second row of the first output cells 206 outputs the gate signal G2 to the second row of the pixel 202. After the second row of the first output cells 206 has outputted the gate signal G2 to the second row of the pixel 202, the downward transmission start signal U2D_STV is transmitted to the second shift register 214 via the start signal line 280. When the second clock CK' rises from the low voltage VGL to the high voltage VGH, the second shift register 214 outputs the high voltage VGH of the second clock signal CK' to 3 rows of the second output cells 216. When the pulse signal P4 and the second clock signal CK' are both at the high voltage VGH, the first row of the second output cells 216 outputs the gate signal G3 to the third row of the pixel 202. After the first row of the second output cells 216 has outputted the gate signal G3 to the third row of the pixel 202, the downward transmission start signal U2D_STV is transmitted to the first shift register 204 via the start signal line 280. When the pulse signal P3 and the first clock signal CK are both at the high voltage VGH, the third row of the first output cells 206 outputs the gate signal G4 to the fourth row of the pixel 202. After the third row of the first output cells 206 has outputted the gate signal G4 to the fourth row of the pixel 202, the downward transmission start signal U2D_STV is transmitted to the second shift register 214 via the start signal line 280. When the pulse signal P5 and the second clock signal CK' are both at the high voltage VGH, the second row of the second output cells 216 outputs the gate signal G5 to the fifth row of the pixel 202. When the pulse signal P6 and the second clock signal CK' are both at the high voltage VGH, the third row of the second output cells 216 outputs the gate signal G6 to the sixth row of the pixel 202. Gate signals G7 to G12 are outputted by the third output cells 226 and the fourth output cells 236 according to the third clock signal XCK, the fourth clock signal XCK' and the pulse signals P1 to P6 in an analogous manner. Alternatively, the LCD panel 1200 may begin to scan the pixel array 202 from bottom to top on receiving the upward transmission start signal D2U_STV.

Figure 14:
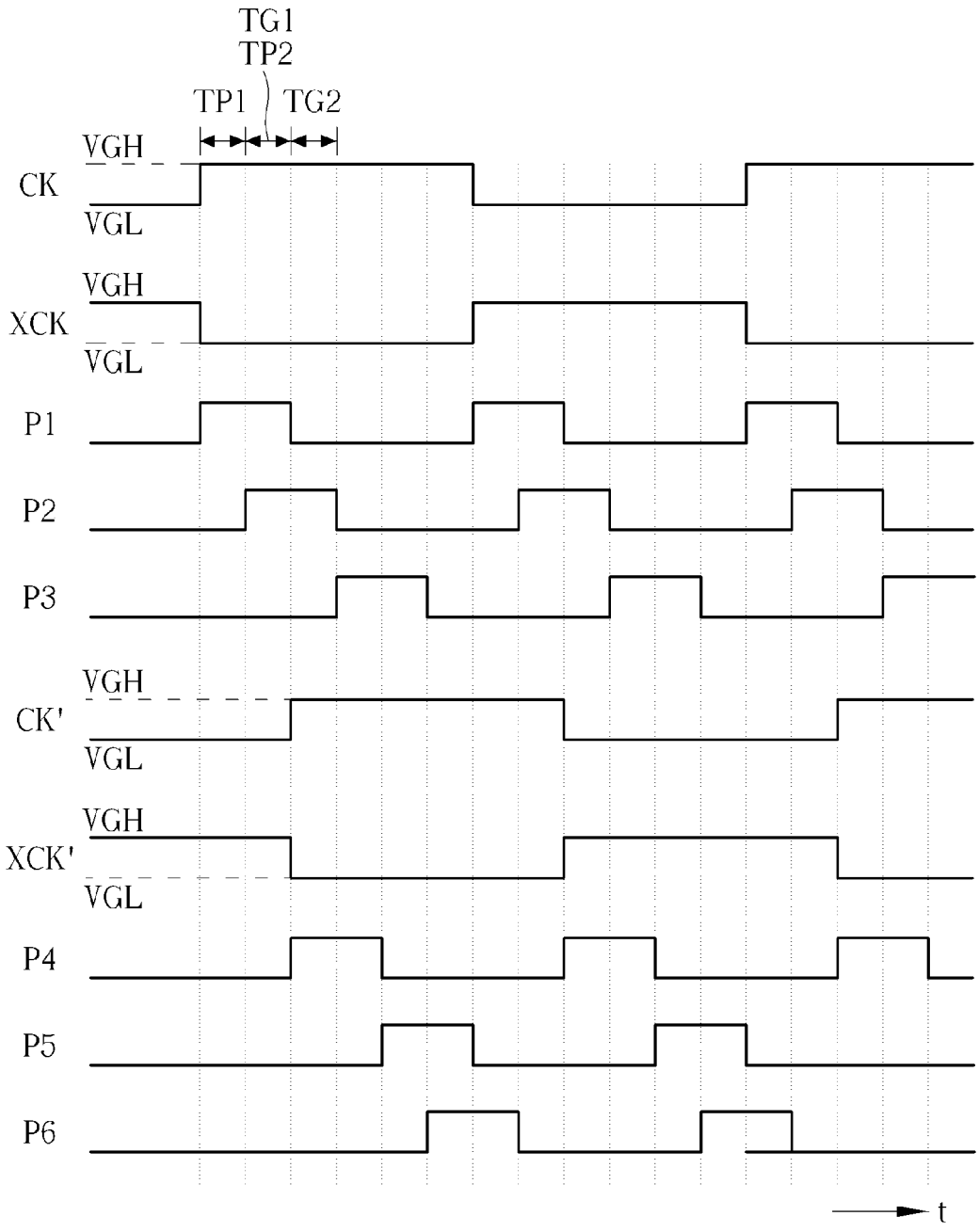
FIG. 14 is a timing diagram illustrating operations of the LCD panel according to another embodiment of the disclosure.

FIG. 14 is a timing diagram illustrating operations of the LCD panel 1200 according to another embodiment of the disclosure. Each pulse signal in FIG. 14 contains an extra pre-charge period comparing with each pulse signal in FIG. 13. For example, when the pulse signal P1 and the first clock signal CK are both at the high voltage VGH, the first row of the first output cells 206 does not output the gate signal G1 during TP1 because TP1 is the pre-charge period. The gate signal G1 is then outputted during TG1. Similarly, when the pulse signal P2 and the first clock signal CK are both at the high voltage VGH, the second row of the first output cells 206 does not output the gate signal G2 during TP2 because TP2 is also the pre-charge period. The gate signal G2 is then outputted during TG2. Other gate signals in FIG. 14 are outputted in an analogous manner.

In summary, embodiments of the disclosure disclose two side co-used shift register structures, that is, each shift register may be utilized to drive multiple rows of pixels, and shift registers are laid out in a zigzag arrangement along two different sides of the pixel array. Thus layout areas required for laying out each shift register in LCD panel may be greatly reduced so that components and traces in the shift register may be completely laid out inside a narrow LCD panel's outer frame with limited layout space.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A liquid crystal display panel comprising:

a pixel array;

a first shift register disposed on a first side of the pixel array for outputting a first clock signal, the first shift register comprising:

a first transistor having a control terminal for receiving an upward transmission signal and a first terminal for receiving an upward transmission start signal;

a second transistor having a control terminal for receiving a downward transmission signal, a first terminal coupled to the first terminal of the first transistor, and a second terminal coupled to a second terminal of the first transistor;

a third transistor having a control terminal coupled to the control terminal of the second transistor, a first terminal for receiving a downward transmission start signal, and a second terminal coupled to the second terminal of the second transistor;

a fourth transistor having a control terminal coupled to the control terminal of the first transistor, a first terminal coupled to the first terminal of the third transistor, and a second terminal coupled to the second terminal of the third transistor;

a fifth transistor having a control terminal coupled to the second terminal of the first transistor and a first terminal coupled to the control terminal of the fifth transistor;

a sixth transistor having a control terminal coupled to the control terminal of the fifth transistor and a first terminal coupled to a second terminal of the fifth transistor;

a seventh transistor having a control terminal coupled to a second terminal of the sixth transistor and a first terminal for receiving the first clock signal;

an eighth transistor having a control terminal coupled to the control terminal of the seventh transistor, a first terminal coupled to a second terminal of the seventh transistor, and a second terminal coupled to the first terminal of the eighth transistor;

a ninth transistor having a control terminal coupled to the second terminal of the eighth transistor, a first terminal coupled to the first terminal of the sixth transistor, and a second terminal coupled to the control terminal of the ninth transistor;

a tenth transistor having a control terminal coupled to the control terminal of the ninth transistor and a first terminal for receiving a high voltage;

an eleventh transistor having a control terminal coupled to the control terminal of the tenth transistor, a first terminal coupled to a second terminal of the tenth transistor, and a second terminal for receiving a low voltage;

a twelfth transistor having a control terminal coupled to the second terminal of the first transistor and a first terminal coupled to the second terminal of the tenth transistor;

a thirteenth transistor having a control terminal coupled to the control terminal of the twelfth transistor, a first terminal coupled to a second terminal of the twelfth transistor, and a second terminal coupled to the second terminal of the eleventh transistor;

a fourteenth transistor having a control terminal coupled to the second of the twelfth transistor, a first terminal coupled to the second terminal of the sixth transistor, and a second terminal coupled to the control of the tenth transistor;

a fifteenth transistor having a control terminal coupled to the control terminal of the fourteenth transistor and a first terminal coupled to the second terminal of the fourteenth transistor; and a sixteenth transistor having a control terminal coupled to the control terminal of the fourteenth transistor, a first terminal coupled to a second terminal of the fifteenth transistor, and a second terminal coupled to the second terminal of the eleventh transistor;

M first output cells coupled to and next to the first shift register for providing M gate signals to M rows of the pixel array according to the first clock signal, the M first output cells comprising:

M first logic gates coupled to the first shift register for generating M pre-buffered gate signals according the first clock signal and respectively corresponding pulse signals; and M first buffers, each first buffer coupled to a corresponding first logic gate, for receiving the M pre-buffered gate signals to provide M gate signals;

a second shift register disposed on a second side of the pixel array for outputting a second clock signal; and N second output cells coupled to and next to the second shift register for providing N gate signals to N rows of the pixel array according to the second clock signal, the N second output cells comprising:

N second logic gates coupled to the second shift register for generating N pre-buffered gate signals according the second clock signal and respectively corresponding pulse signals; and N second buffers, each second buffer coupled to a corresponding second logic gate, for receiving the N pre-buffered gate signals to provide N gate signals;

wherein the first side is different from the second side, the second shift register providing the N gate signals sequentially through the N second output cells according to an $M^{th}$ gate signal of the M gate signals after the M gate signals are provided by the M first output cells, and M and N are both positive integers greater than 1.

2. The liquid crystal display panel of claim 1 wherein the M first output cells are disposed above the first shift register and the N second output cells are disposed below the second shift register.

3. The liquid crystal display panel of claim 2 wherein width of the first shift register is not greater than width of each first output cell and width of the second shift register is not greater than width of each second output cell.

4. The liquid crystal display panel of claim 1 wherein the M first output cells are disposed above the N second output cells.

5. The liquid crystal display panel of claim 1 wherein the M first output cells and the N second output cells are arranged zigzagly.

6. The liquid crystal display panel of claim 1 wherein M=N=3, a first row of the N second output cells is arranged below a first row and a second row of the M first output cells and above a third row of the M first output cells, and the third row of the M first output cells is arranged above a second row and a third row of the N second output cells.

7. The liquid crystal display panel of claim 1 further comprising a start signal line coupled between the first shift register and the second shift register by traversing through the pixel array.

8. The liquid crystal display panel of claim 7 wherein the start signal line is disposed between the first shift register and the second shift register.

9. The liquid crystal display panel of claim 1 further comprising:

a third shift register disposed on the first side of the pixel array for outputting a third clock signal;

M third output cells coupled to and next to the third shift register for providing M gate signals to M rows of the pixel array according to the third clock signal;

a fourth shift register disposed on the second side of the pixel array for outputting a fourth clock signal; and N fourth output cells coupled to and next to the fourth shift register for providing N gate signals to N rows of the pixel array according to the fourth clock signal.

10. The liquid crystal display panel of claim 9 wherein the M third output cells comprises:

M third logic gates coupled to the third shift register for generating M pre-buffered gate signals according the third clock signal and respectively corresponding pulse signals; and M third buffers, each third buffer coupled to a corresponding third logic gate, for receiving the M pre-buffered gate signals to provide M gate signals; and the N fourth output cells comprises:

N fourth logic gates coupled to the fourth shift register for generating N pre-buffered gate signals according the fourth clock signal and respectively corresponding pulse signals; and N fourth buffers, each fourth buffer coupled to a corresponding fourth logic gate, for receiving the N pre-buffered gate signals to provide N gate signals.

11. The liquid crystal display panel of claim 1 wherein each first logic gate comprises:

seventeenth transistor having a control terminal for receiving the corresponding pulse signal and a first terminal coupled to the second terminal of the tenth transistor; and an eighteenth transistor having a control terminal coupled to the control terminal of the seventeenth transistor, a first terminal coupled to a second terminal of the seventeenth transistor, and a second terminal for receiving a pulse off signal.

12. The liquid crystal display panel of claim 11 wherein each first buffer comprises:

a nineteenth transistor having a control terminal coupled to the second terminal of the seventeenth transistor, a first terminal for receiving the high voltage, and a second terminal for outputting the gate signal; and a twentieth transistor having a control terminal coupled to the control terminal of the nineteenth transistor, a first terminal coupled to the second terminal of the nineteenth transistor, and a second terminal coupled to the second terminal of the eleventh transistor.

* * * * *